US012344428B2

(12) United States Patent
Skeberg

(10) Patent No.: US 12,344,428 B2
(45) Date of Patent: Jul. 1, 2025

(54) APPARATUS AND A METHOD FOR MANUFACTURING A POUCHED PRODUCT FOR ORAL USE AND A POUCHED PRODUCT FOR ORAL USE

(71) Applicant: Swedish Match North Europe AB, Stockholm (SE)

(72) Inventor: Fred Skeberg, Varberg (SE)

(73) Assignee: SWEDISH MATCH NORTH EUROPE AB, Stockholm (SE)

( * ) Notice: Subject to any disclaimer, the term of this patent is extended or adjusted under 35 U.S.C. 154(b) by 391 days.

(21) Appl. No.: 18/000,082

(22) PCT Filed: Jun. 17, 2021

(86) PCT No.: PCT/EP2021/066328
§ 371 (c)(1),
(2) Date: Nov. 28, 2022

(87) PCT Pub. No.: WO2022/002600
PCT Pub. Date: Jan. 6, 2022

(65) Prior Publication Data

US 2023/0211907 A1 Jul. 6, 2023

(30) Foreign Application Priority Data

Jun. 30, 2020 (EP) ..... 20183078

(51) Int. Cl.
*B65B 9/18* (2006.01)
*A24B 13/00* (2006.01)
*B65B 29/02* (2006.01)

(52) U.S. Cl.
CPC ..... *B65B 9/18* (2013.01); *A24B 13/00* (2013.01); *B65B 29/02* (2013.01)

(58) Field of Classification Search
CPC ..... B65B 9/18; B65B 29/02; B65B 37/02; B65B 51/225; B65B 51/303; B65B 61/06;
(Continued)

(56) References Cited

U.S. PATENT DOCUMENTS

| | | | |
|---|---|---|---|
| 2,712,824 A | 7/1955 | Steiner | |
| 4,495,751 A | 1/1985 | Galbiati | |
| 2018/0257801 A1* | 9/2018 | Persson | B29C 66/81413 |

FOREIGN PATENT DOCUMENTS

| | | |
|---|---|---|
| EP | 2604535 A1 | 6/2013 |
| EP | 3087852 A1 | 11/2016 |
| EP | 3383746 B1 | 8/2019 |

OTHER PUBLICATIONS

International Search Report for PCT/EP2021/066328 dated Aug. 30, 2021.

* cited by examiner

*Primary Examiner* — Philip Y Louie
*Assistant Examiner* — Oluwatosin O Diyan
(74) *Attorney, Agent, or Firm* — Knobbe Martens Olson & Bear LLP

(57) ABSTRACT

The present invention relates to an apparatus (1) and a method for manufacturing a pouched product (201) for oral use. The present invention further relates to a pouched product (201) for oral use. The apparatus comprises a supplying unit (3) for supplying a filling material (5), a holding unit (7) for holding a piece (9) of tubular web of a saliva-permeable packaging material, the piece of tubular web having a predefinable length when provided to the holding unit, a transverse sealing unit (11) for providing the piece of tubular web with transverse seals (13) thereby forming a pouched product, and a separation unit (15) for separating the pouched product from a subsequent pouched product (201') in or at the transverse seals. The holding unit
(Continued)

comprises guiding provisions (17) for guiding the filling material from the supplying unit to be supplied into the piece of tubular web at an end (19) of the holding unit, wherein a length of the holding unit ($L_h$) is at least 35 cm.

14 Claims, 6 Drawing Sheets

(58) Field of Classification Search
CPC ..... B65B 29/00; B65B 39/06; B65B 9/15; A24B 13/00; A24B 13/02; A24B 9/00; A24F 23/02; A24C 1/00
USPC ..... 131/111, 239
See application file for complete search history.

APPARATUS AND A METHOD FOR MANUFACTURING A POUCHED PRODUCT FOR ORAL USE AND A POUCHED PRODUCT FOR ORAL USE

CROSS REFERENCE TO RELATED APPLICATIONS

This application is a U.S. National Phase Application of PCT International Application Number PCT/EP2021/066328, filed on Jun. 17, 2021, designating the United States of America and published in the English language, which is an International Application of and claims the benefit of priority to European Patent Application No. 20183078.3, filed on Jun. 30, 2020. The disclosures of the above-referenced applications are hereby expressly incorporated by reference in their entireties.

TECHNICAL FIELD

The present invention relates to an apparatus and a method for manufacturing a pouched product for oral use. The present invention further relates to a pouched product for oral use.

BACKGROUND

A pouched product for oral use may be produced by measuring a portion of a filling material, e.g. a smokeless tobacco composition, and enclosing the portion into a packaging material forming a saliva-permeable pouch enclosing the filling material.

U.S. Pat. No. 4,703,765 discloses a device for packaging precise amounts of finely divided tobacco products, such as snuff tobacco or the like, in a packaging material into which snuff portions are injected via a fill tube. A flat web of packaging material is formed into a tubular web around the fill tube. Downstream from the fill tube, welding means are positioned for transverse sealing of the packaging material, and also cutting means for severing the packaging material in the area of the transverse seal to thus form discrete or individual portion packages.

A pouched product made in the device disclosed in U.S. Pat. No. 4,703,765 has a longitudinal seal used to form the flat web of packaging material into the tubular web as well as a two transverse seals forming a respective transverse edge of the product. Since the transverse seals are made after the longitudinal seal, i.e. downstream of the longitudinal seal in the device, the packaging material in the longitudinal seal is included in the transverse seals. Hence, at those locations, the packaging material forming the saliva-permeable pouch has four plies on top of each other, which may negatively affect mouth comfort and/or liquid permeability.

Pouched products for oral use may alternatively be produced by placing portions of a filling material, such as moist snuff, on a nonwoven web using a pouch packer machine in accordance with the device disclosed in U.S. Pat. No. 6,135,120. This device comprises feeding means for feeding the tobacco material into pockets formed in a rotary portioning wheel for portioning the material into portions, at least one compression means for compressing the tobacco material portions, a unit for advancing a packaging material, such as a nonwoven web, in synchrony with the portions, at least one discharge means for discharging the portions from the pockets to the packaging material, and a forming unit for forming individual portion-packages, i.e. pouched products for oral use, from the discharged portions and the packaging material. At the intended point of discharge of the portions to the packaging material, the packaging material has the form of a tape. The compression means are arranged to compress the portions in a direction which differs from the discharging and the feeding directions. The compression is preferably effected in a direction perpendicular to the discharging and the feeding directions. The compression may be effected in the axial direction of the portioning wheel whereas the feeding and discharging may be effected in the radial direction of the wheel.

Also the pouched product made in the device disclosed in U.S. Pat. No. 6,135,120 has a longitudinal seal used to form the tape of packaging material into a tubular web as well as a two transverse seals forming a respective transverse edge of the product. Since the transverse seals are made after the longitudinal seal, i.e. downstream of the longitudinal seal in the device, the packaging material in the longitudinal seal is included in the transverse seal. Hence, at those locations, the packaging material forming the saliva-permeable pouch has four plies on top of each other, which may negatively affect mouth comfort and/or liquid permeability.

Even if there exist a number of known apparatuses and methods for manufacturing pouched products for oral use, as exemplified above, there is still a desire to further improve the apparatus and/or the method to be able to provide pouched products for oral use, which are improved in relation to today's products, e.g. regarding mouth feel, flavour experience, visual appearance, material use and/or production cost. In particular, it is desirable to provide pouched products for oral use, which have a more conformable pouch and preferably also a better liquid permeability than previously known pouched products.

SUMMARY

The object of the present disclosure is to overcome or ameliorate at least one of the disadvantages of the prior art, or to provide a useful alternative.

The object above is achieved by the subject-matter of the independent claims. Embodiments are set forth in the appended dependent claims, in the following description and in the drawings.

The present invention relates to an apparatus for manufacturing a pouched product for oral use according to claim 1. The apparatus comprises a supplying unit for supplying a filling material, a holding unit for holding a piece of tubular web of a saliva-permeable packaging material, the piece of tubular web having a predefinable length when provided to the holding unit, a transverse sealing unit for providing the piece of tubular web with transverse seals thereby forming a pouched product, and a separation unit for separating the pouched product from a subsequent pouched product in or at the transverse seals.

The holding unit comprises guiding provisions for guiding the filling material from the supplying unit to be supplied into the piece of tubular web at an end of the holding unit, wherein a length of the holding unit is at least 35 cm.

By utilizing an apparatus according to the invention, it is possible to provide a pouched product for oral use without any longitudinal seal. This is possible since the saliva-permeable packaging material is provided to the apparatus as an already formed tubular web. This differs from prior art apparatuses, in which the tubular web is formed as a continuous web by means of longitudinal sealing.

The absence of the longitudinal seal makes it possible to provide a pouched product, wherein the packaging material forming the saliva-permeable pouch locally has at the most two plies on top of each other, which is the case in the transverse seals. For the rest of the pouch, there is only a single ply of the packaging material around the filling material. Hence, the saliva-permeable pouch of the pouched product consists of a single ply of packaging material along a full length of the pouched product between the transverse seals.

This results in less packaging material being used for each pouched product according to the invention as compared to a prior art product having the same outer dimensions, since there is no extra material in any longitudinal seal. Less packaging material means lowered material cost for the product. In addition, there is no longitudinal sealing unit, which potentially could represent a speed limit for a manufacturing apparatus, and which also sometimes needs cleaning, maintenance and/or repair.

The pouched product according to the invention has a neater visual appearance as compared to a prior art product having the same outer dimensions, since there is no longitudinal seal.

Moreover, the user of the pouched product according to the invention may have an improved experience from the product when placed in the mouth as compared to a prior art product having the same outer dimensions. The pouched product according to the invention may give a better mouthfeel, since there is no longitudinal seal. In addition, flavour release may be improved, since the flavour can be released through the whole surface of the pouch without being locally obstructed by the packaging material in the longitudinal seal. The pouched product according to the invention may have a better conformability than prior art products since there is less overlapping packaging material. In particular, there is no overlapping packaging material in a region of the pouched product, in which filling material is present. This may also give a better liquid permeability, e.g. for saliva.

The pouched product for oral use may be a pouched tobacco product for oral use, e.g. a snuff product or a snus product, a pouched nicotine containing product for oral use or a pouched nicotine-free product for oral use.

The pouched product for oral use may be portion-packed, i.e. each pouch encloses an amount of filling material, which is intended to make up a portion of a suitable size. The pouched product is configured to fit comfortably and discreetly in a user's buccal cavity, e.g. between the upper and/or lower gum and the lip. It is not intended to be swallowed.

The piece of tubular web is a discrete piece of material having a predefinable length, i.e. it is not a section of a continuous tubular web, especially not a section of a continuous tubular web formed in the apparatus. The length is predefined, meaning that the length is decided beforehand, i.e. before the piece of tubular web is provided to the holding unit.

The predefinable length is preferably adapted to the length of the holding unit, such that the piece of tubular web fits at the holding unit.

The pouched product for oral use described herein may be dry, semi-dry or moist. Generally, dry pouched products have a moisture content of less than 10 wt % and moist pouched products have a moisture content of above 40 wt %. Semi-dry pouched products have a moisture content between 10 wt % and 40 wt %.

The pouched product may be flavoured by mixing the flavour in the filling material during manufacturing. Additionally or alternatively, the flavour may be added to the pouched product after it has been manufactured.

By the term "tobacco" as used herein is meant any part, e.g., leaves, stems, and stalks, of any member of the genus *Nicotiana*. The tobacco may be whole, shredded, threshed, cut, ground, cured, aged, fermented, or treated otherwise, e.g. granulated or encapsulated.

The term "tobacco material" is used herein for tobacco leaves or parts of leaves, such as lamina and stem. The leaves and parts of leaves may be finely divided (disintegrated), such as ground, cut, shredded or threshed, and the parts of leaves may be blended in defined proportions in the tobacco material.

The filling material may comprise a finely divided tobacco material such as a ground tobacco material or cut tobacco. In addition to the tobacco material, the filling material may further comprise at least one of the following: water, salt (e.g. sodium chloride, potassium chloride, magnesium chloride, and any combinations thereof), pH adjuster, flavouring agent, cooling agent, heating agent, sweetening agent, colorant, humectant (e.g. propylene glycol or glycerol), antioxidant, preservative (e.g. potassium sorbate), binder, disintegration aid. In an example, the filling material comprises or consists of finely divided tobacco material, salt such as sodium chloride, and a pH adjuster.

For pouched products with no or low tobacco content, to which nicotine is added, the nicotine of the filling material may be synthetic nicotine and/or nicotine extract from tobacco plants. Further, the nicotine may be present in the form of nicotine base and/or a nicotine salt. The nicotine salt may be free, i.e. it is mixed with the other components of the product without combining chemically with said components. Additionally or alternatively, the nicotine salt may combine chemically with one or more components of the filling material. For instance, the nicotine salt may combine with alginate particles or cellulose.

As used herein, the term "moisture content" refers to the total amount of oven volatile ingredients, such as water and other oven volatiles (e.g. propylene glycol) in the preparation, composition or product referred to. The moisture content may be given herein as percent by weight (wt %) of the total weight of the preparation, composition or product referred to. If not stated otherwise, moisture content is herein given in relation to the weight of the filling material.

The moisture content as referred to herein may be determined by using a method based on literature references Federal Register/vol. 74, no. 4/712-719/Wednesday, Jan. 7, 2009/Notices "Total moisture determination" and AOAC (Association of Official Analytical Chemics), Official Methods of Analysis 966.02: "Moisture in Tobacco" (1990), Fifth Edition, K. Helrich (ed). In this method, the moisture content is determined gravimetrically by taking 2.5±0.25 g sample and weighing the sample at ambient conditions, herein defined as being at a temperature of 22° C. and a relative humidity of 60%, before evaporation of moisture and after completion of dehydration. Mettler Toledo's Moisture Analyzer HB43, a balance with halogen heating technology, is used (instead of an oven and a balance as in the mentioned literature references) in the values described herein. The sample is heated to 105° C. (instead of 99.5±0.5° C. as in the mentioned literature references). The measurement is stopped when the weight change is less than 1 mg during a 90 seconds time frame. The moisture content as weight percent of the sample is then calculated automatically by the Moisture Analyzer HB43.

Pouched products for oral use may or may not be post-moisturized after pouch formation. Pouched products which are not post-moisturized are herein referred to as non-post-moisturized. Post-moisturized pouched products may be produced by spraying water on the pouched product before packaging the pouched products in user containers. Post-moisturized pouches are sometimes referred to as "original" products. Non-post-moisturized pouched products are sometimes referred to as "white" products and are by some consumers considered to have a more appealing visual appearance. The moisture content of the final pouched product comprising a moist or semi-dry snuff or snus product is normally within the range of from 25 to 55 wt % based on the weight of the pouched product.

The saliva-permeable packaging material, which is used for the pouch, is typically a nonwoven material, such as viscose. It may include a chemical binder. Nonwoven materials are fabrics that are neither woven nor knitted. Methods for the manufacturing nonwoven materials are commonly known in the art.

Pouched products for oral use are normally sized and configured to fit comfortably and discreetly in a user's mouth between the upper or lower gum and the lip. In general, pouched products for oral use have a generally rectangular shape. Some typical shapes (length×width) of commercially available pouched products for oral use are, for instance, 35 mm×20 mm, 34/35 mm×14 mm, 33/34 mm×18 mm, 27/28 mm×14 mm, 34 mm×10 mm and 38×14 mm. Typical pouched products for oral use may have a maximum length within the range of from 25 to 40 mm along the longitudinal direction of the product and a maximum width within the range of from 5 to 20 mm along the transverse direction of the product. The thickness ("height") of the pouched product is normally within the range of from 2 to 8 mm. The total weight of commercially available pouched products for oral use are typically within the range from about 0.3 to about 3.5 g, such as from about 0.5 to 1.7 g, per pouched product.

A user container typically contains in the range of 10-30 pouched products, such as in the range of 20-25 pouched products. The pouched products may be placed randomly in the user container or in a pattern, for instance as described in WO 2012/069505 A1. The user container as disclosed herein is consumer package having a shape and a size adapted for conveniently carrying the consumer package in a pocket or in a handbag and may be used for packaging any known type of pouched product for oral use.

The term "tubular" as used herein refers to any cross-sectional shape; specifically, it is not restricted to a circular tubular web. The piece of tubular web may e.g. have a square, polygonal, elliptical or oval cross-sectional shape. However, the piece of tubular web has a closed circumference, such that the piece of tubular web is able to retain the filling material inside the piece of tubular web.

The supplying unit is adapted to supply the filling material, e.g. as a portion of the filling material, i.e. an amount of filling material, which is intended to make up a portion of a suitable size for the user. In that case, each pouch will enclose one portion of the filling material.

The supplying unit and the holding unit may be combined into a common unit. In that case, they together form a single unit in the apparatus described herein.

The guiding provisions of the holding unit may comprise a feeding nozzle, e.g. a funnel part, for easily introducing the filling material into the piece of tubular web of saliva-permeable packaging material. The holding unit may assume a vertical or a horizontal direction or any direction therebetween. The filling material may fall down into the piece of tubular web by means of gravity. As an alternative or a complement, the filling material may be pushed, e.g. mechanically or by pressurized gas such as pressurized air, and/or the filling material may be sucked into the piece of tubular web.

The holding unit may comprise, or be constituted by, a filling tube. Thereby, the piece of tubular web is held at the outside of the filling tube. Further, the filling tube may function as the guiding provisions, such that the filling material may move through the filling tube from the supplying unit into the piece of tubular web.

The apparatus further comprises a transverse sealing unit for providing the piece of tubular web with a series of transverse seals by repeated transverse sealing. The transverse seals are transverse to a direction of travel of the piece of tubular web. The transverse sealing unit may e.g. be a heat-welding unit or an ultrasonic sealing unit. The transverse seal may have a width of less than 2 mm, preferably less than 1 mm, more preferably less than 0.5 mm. An example of an ultrasonic sealing unit for transverse sealing is given in EP 3383746 B1, wherein the sealing unit and the separation unit forms a combined unit.

The transverse sealing unit typically operates repetitively, such that two subsequent transverse seals are interspaced by a repetition distance, determined as a centre-to-centre distance. The transverse sealing unit may travel together with the piece of tubular web for a predeterminable distance while performing the welding, as e.g. is described in EP 3383746 B1.

Commonly, the transverse sealing unit operates in such a way that it simultaneously forms a second transverse edge seal of a first pouched product and a first transverse edge seal of a second subsequent pouched product.

The two transverse seals sealing the respective ends of the pouched product are interspaced by a repetition distance. Thus, the width and length dimensions of the product are determined by the length of the transverse seal and the repetition distance, respectively. Further, the product also has a height in a thickness dimension, which i.a. depends on how much filling material is filled into each product. Typically, the pouch of the pouched product is not maximally filled, but rather the filling material is displaceable within the pouch, such that the products could rather be described as pillow-like, e.g. like a small flattened typically somewhat oblong pillow. Due to the thickness, a product is typically narrower, i.e. less wide, at its waist as compared to when measuring the width at its edge, just like a typical pillow. Further, the length and the width of the product are typically larger than the height of the product.

The transverse seals made by the transverse sealing unit typically have a length corresponding to a collapsed cross-sectional shape of the piece of tubular web. The length of the transverse seal is determined in a direction transverse to the direction of travel of the piece of tubular web. When being transversely sealed, the tubular web is pressed together to a straight line of doubled packaging material giving the collapsed cross-sectional shape. Hence, the length of the transverse seal equals, or substantially equals, half of the circumference of the tubular web.

The apparatus also comprises a separation unit for separating two consecutive pouched products from each other, e.g. by cutting in or at the transverse seals. It is thus feasible to form a transverse seal in the piece of tubular web by means of the transverse sealing unit, which seal is cut at its centre or close to its centre, such that one part of the seal, e.g. substantially half the seal, forms a first transverse edge seal in one pouched product and the other part of the seal, e.g. substantially the other half, forms a second transverse edge seal in the preceding pouched product. In that case, the transverse seal formed in the piece of tubular web is substantially twice as wide, as seen in the direction of travel of the piece of tubular web, as compared to an individual transverse edge seal of the product.

The term "transverse seal" as used herein relates to the seal being formed in the apparatus according to the invention extending in the piece of tubular web in the transverse direction, i.e. the direction being perpendicular to the direction of travel. The term "edge seal" as used herein relates to a seal of the pouched product. The edge seal seals an edge of the product. The "transverse edge seal" thereby seals the edge, which was oriented perpendicular to the direction of travel of the piece of tubular web in the apparatus.

As a result of the transverse sealing and the separation in the apparatus, each pouched product for oral use is delimited, as seen along the direction of travel, by a pair of opposite transverse edge seals. If the direction of travel of the piece of tubular web is vertical, there will thus be a lower transverse edge seal and an upper transverse edge seal, when the transverse seals are formed during manufacturing of the pouched product.

As an alternative to cutting a transverse seal formed in the apparatus into two parts as e.g. described in EP 3383746 B1, separation may be performed by means of a separate knife or blade operating in an interspace between two separately formed transverse edge seals in the piece of tubular web. The interspace may be adapted to the space needed for the blade or knife.

As yet an alternative, the separation unit may form a separate unit, i.e. not being part of the transverse sealing unit. It may then be located spaced apart from the transverse sealing unit. It is then preferable that the separation unit, although being separate from the transverse sealing, operates in synchrony with the transverse sealing unit.

The length of the holding unit may be in the range of 35-200 cm, preferably in the range of 40-150 cm, more preferably in the range of 45-110 cm, most preferably in the range of 50-100 cm. With a greater length, a longer piece of tubular web may be held on the holding unit.

The holding unit may be configured to hold the piece of tubular web in a gathered state. In that case, the apparatus may further comprise a feeding unit for feeding the piece of tubular web in the direction of travel of the piece of tubular web, thereby sequentially expanding the piece of tubular web from the gathered state to a flat state. The feeding unit may then be located at or adjacent to the end of the holding unit, such that the filling material is supplied into the piece of tubular web when in the flat state.

Accordingly, such an apparatus comprises a supplying unit for supplying a filling material, a holding unit for holding a piece of tubular web of a saliva-permeable packaging material in a gathered state, a feeding unit for feeding the piece of tubular web in the direction of travel of the piece of tubular web, thereby sequentially expanding the piece of tubular web from the gathered state to a flat state, a transverse sealing unit for providing the piece of tubular web being in the flat state with transverse seals thereby forming a pouched product, and a separation unit for separating the pouched product from a subsequent pouched product in or at the transverse seals. The holding unit comprises guiding provisions for guiding the filling material from the supplying unit to be supplied into the piece of tubular web at an end of the holding unit. The feeding unit is located at or adjacent to the end of the holding unit, such that the filling material is supplied into the piece of tubular web when in the flat state.

The terms gathered state and flat state are to be understood as a pair, in case the piece of tubular web is provided in the gathered state. The flat state then relates to the state after expansion, i.e. to an expanded state. A length of the piece of tubular in the gathered state is less than a length of the piece of tubular in the flat state. The flat state corresponds to the state the packaging material has in the pouch of the pouched product, i.e. a substantially flat surface although the pouched product has a three-dimensional shape, such as pillow-like, e.g. like a small flattened typically somewhat oblong pillow. A length of the piece of tubular web in the gathered state may be in the range of 5-50 cm, preferably in the range of 10-40 cm, more preferably in the range of 15-30 cm, most preferably in the range of 20-25 cm. A length of the piece of tubular web in the flat state, after expansion, may then be in the range of 35-500 cm, preferably in the range of 40-400 cm, more preferably in the range of 45-300 cm, most preferably in the range of 50-200 cm.

The piece of tubular web may be supplied in the gathered state to the apparatus or it may be transformed from the flat state to the gathered state during loading in the apparatus.

However, as is understood from the disclosure herein, the feeding unit is optional. It thus possible to provide the piece of tubular web to the apparatus in the flat state and to hold it on the holding unit in the flat state. In that case, no expansion of the piece of tubular web is needed, or even desired. Hence, the length of the piece of tubular web as provided to the holding unit is adapted to the length of the holding unit. In that case, the feeding unit may be dispensed with or used only to move the piece of tubular web in the direction of travel, since no expansion is performed.

The feeding unit may be adapted to move the piece of tubular web in a direction opposite to the direction of travel, such that the piece of tubular web is loaded onto the holding unit. Hence, the same feeding unit may be used both for loading and unloading of the piece of tubular web on the holding unit. If the piece of tubular web is provided in the gathered state, the feeding unit may load the piece of tubular web in that gathered state. If the piece of tubular web is provided in the flat state, the feeding unit may transform it to the gathered state during loading.

The feeding unit may comprise one or more pulling wheels or pulling belts. The pulling wheels or pulling belts may be used to move the piece of tubular web in the direction of travel. They may be adapted to pull out the piece of tubular web, thereby sequentially expanding it from the gathered state to the flat state, corresponding to the expanded state. They may also be operable in the other direction, such that they may be utilized to load the piece of tubular web on the holding unit.

Even if the piece of web is not provided in the gathered state, but in the flat state, a feeding unit, as described herein, may anyway be useful. It can move the piece of tubular web in a direction of travel. It can also be used to move the piece of tubular web in a direction opposite to the direction of travel, such that the piece of tubular web is loaded onto the holding unit. Hence, the same feeding unit may be used both for loading and unloading of the piece of tubular web on the holding unit also for a piece of tubular web in the flat state.

The apparatus may further comprise a loading unit and a storage unit for at least one additional piece of tubular web, the loading unit being displaceable between a first position located at the storage unit, in which the additional piece of tubular web is movable from the storage unit to the loading unit, and a second position located at the holding unit, in which the additional piece of tubular web is movable from the loading unit to the holding unit. In that case, the piece of tubular web has such characteristics that it forms a kind of tube itself, which preferably is self-supportive. The piece of tubular web may then be supplied in the gathered state.

The apparatus may comprise a plurality of holding units adapted to be used sequentially together with the supplying unit, each holding unit being adapted for holding a respective separate piece of tubular web of saliva-permeable packaging material. The holding units are adapted to be used one at the time after each other. The holding unit may thus be prepared in advance and/or outside the apparatus by loading a piece of tubular web onto it. Hence, when a first piece of tubular web has been transformed into pouched products and it is time to shift to a new piece of tubular web, the whole holding unit is shifted, such that a new holding unit is moved to the supply unit of the apparatus. Such a solution may increase the output of the apparatus, since the manufacturing of pouched products is not slowed down by loading a new piece of tubular web.

The apparatus may further comprise a magazine being adapted for storing the plurality of holding units, the magazine being adapted to move one holding unit at a time into a filling position in relation to the supplying unit, e.g. by means of a linear and/or rotational translation of the magazine in relation to the supplying unit.

The present invention further relates to a method for manufacturing a pouched product for oral use. The method comprises:

a) providing and holding a piece of tubular web of a saliva-permeable packaging material on a holding unit, the piece of tubular web having a predefinable length when provided to the holding unit, b) providing the piece of tubular web with a first transverse seal, c) supplying a filling material through the holding unit into the piece of tubular web, d) advancing the piece of tubular web in a direction of travel, e) providing the piece of tubular web with a second transverse seal thereby forming a pouched product, f) separating the pouched product from a subsequent pouched product in or at the second transverse seal.

The method is preferably performed by an apparatus as described herein. For details of the method steps, please see also the description of the corresponding parts of the apparatus. The piece of tubular web may be moving continuously when performing the method.

The transverse sealing and separation, see steps e) and f) may be performed as a single common operation in a single unit, e.g. by the sealing device disclosed in EP 3383746 B1. Hence, transverse sealing and separation may be performed simultaneously and in the same operation step. It may further be performed by the same operation surface as disclosed in the sealing device of EP 3383746 B1. The transverse sealing may be performed by heat-welding and/or ultrasonic sealing.

The length of the piece of tubular web in the flat state may be in the range of 35-500 cm, preferably in the range of 40-400 cm, more preferably in the range of 45-300 cm, most preferably in the range of 50-200 cm. These length ranges reflect the piece of tubular web being in the state of the pouched product. The length in the flat state may be adapted to the number of pouched products that are to be contained in an integer number of user containers, e.g. one, two or three user containers, such that loading of a new piece of tubular web may be synchronized with provision of a new user container.

Commonly, the transverse sealing is performed in such a way that a second transverse edge seal, e.g. an upper edge seal, of a first pouched product and a first transverse edge seal of a second subsequent pouched product, e.g. a lower edge seal, are formed in the same step. See description above of the apparatus for details. Hence, step e) for a first pouched product is performed simultaneously as step b) for the subsequent pouched product, possibly by the same transverse sealing unit.

In step a), the piece of tubular web of saliva-permeable packaging material may be provided in the gathered state and held on the holding unit in the gathered state, and step b), c) and/or d) may be performed while expanding the piece of tubular web from the gathered state to the flat state, wherein a length of the piece of tubular web, when in the gathered state, is less than a length of the piece of tubular web when in the flat state. Please see the description of the apparatus for further details.

The length of the piece of tubular web in the gathered state may be in the range of 35-200 cm, preferably in the range of 40-150 cm, more preferably in the range of 45-110 cm, most preferably in the range of 50-100 cm.

The method may comprise a step of g) loading a new piece of tubular web of saliva-permeable packaging material onto the holding unit. The step of loading may be combined with a step of gathering the piece of tubular web during the loading. Alternatively, the piece of tubular web may be loaded as is in the flat state or as already being in the gathered state. Please see the description of the apparatus for further details.

The method may comprise a step of h) exchanging an empty holding unit to a new holding unit comprising a new piece of tubular web of saliva-permeable packaging material. The new piece of tubular web may be as is, i.e. in the flat state, or in the gathered state.

The present invention also relates to a pouched product for oral use, the pouched product for oral use comprising a filling material and a saliva-permeable pouch enclosing the filling material. The pouched product for oral use as disclosed herein has a rectangular shape with four sides edges. It comprises two seals only, located at or adjacent to two of the side edges being opposite to each other. The pouched product may be portion-packed, i.e. the amount of filling material is intended to make up a portion of a suitable size.

The pouched product for oral use may be a pouched nicotine-containing product for oral use, a pouched tobacco product for oral use and/or a pouched nicotine-free product for oral use.

The pouched product may be manufactured in the apparatus as described herein and/or with the method as described herein. The present invention also relates to a pouched product as described herein being obtained or obtainable by using the apparatus as described herein. The present invention also relates to a pouched product as described herein being obtained or obtainable by the method as described herein.

BRIEF DESCRIPTION OF THE DRAWINGS

The present invention will hereinafter be further explained by means of non-limiting examples with reference to the appended drawings wherein.

It should be noted that the appended drawings are not necessarily drawn to scale and that the dimensions of some features of the present invention may have been exaggerated for the sake of clarity.

DETAILED DESCRIPTION

The invention will in the following be exemplified by embodiments. It should however be realized that the embodiments are included in order to explain principles of the invention and not to limit the scope of the invention, defined by the appended claims. Details from two or more of the embodiments may be combined with each other.

Figure 1A:
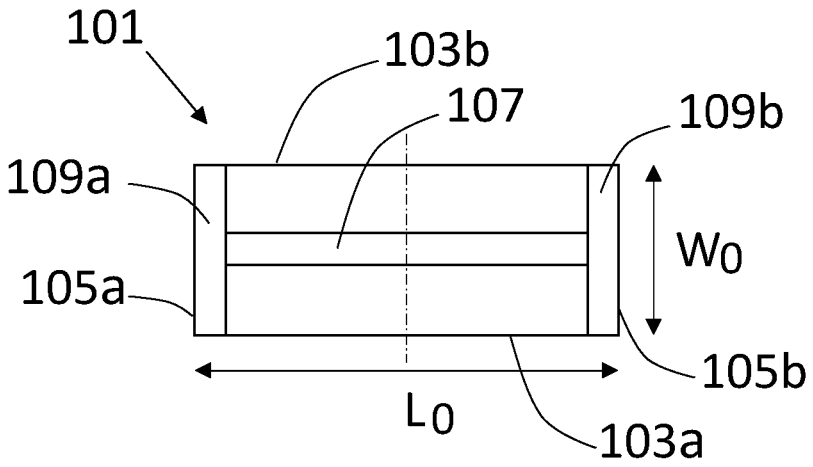
FIG. 1*a-b* illustrate a pouched product for oral use according to prior art.
Figure 1B:
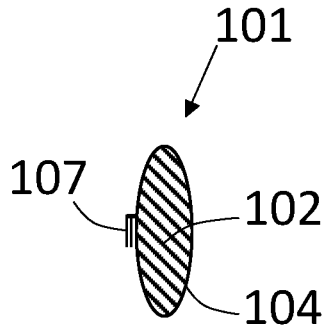

FIGS. 1*a* and 1*b* schematically illustrate a pouched product for oral use 101 according to prior art. The prior art product 101 has a rectangular shape with a maximum length $L_0$ extending in a length direction and a maximum width $W_0$ extending in a width direction, whereby the maximum length $L_0$ is greater than the maximum width $W_0$. The prior art product 101 comprises a filling material 102 and a saliva-permeable pouch 104 enclosing the filling material 102. The prior art product 101 comprises two long side edges 103*a*, 103*b* and two short side edges 105*a*, 105*b*. The prior art product 101 also has an extension in a height direction, being perpendicular to the length direction and to the width direction, however not seen in this perspective.

The prior art product 101 comprises at least one seal 107 extending in the length direction. Typically, and as illustrated in FIG. 1*a*, there is a single seal 107 extending in the length direction. This seal is often called a longitudinal seal, since, when manufacturing the prior art product 101, this seal is made along the direction of travel of the web forming the pouch. The longitudinal seal is often positioned spaced apart from the long side edges 103*a*, 103*b*. Thereby it is often preferred to position it at or close to the longitudinal centre-line, as is illustrated in FIG. 1*a*. The longitudinal seal 107 may be made by any method known to the skilled person, e.g. by means of heat-welding and/or ultrasonic welding. In a commonly used method, the longitudinal seal 107 is formed as a fin seal, which is folded down upon the packaging material, such that the pouch locally comprises three plies of packaging material on top of the filling material. See the cross-sectional view in FIG. 1*b*.

Further, the prior art product 101 comprises two seals 109*a*, 109*b* extending in the width direction. The two seals 109*a*, 109*b* seal the two short side edges 105*a*, 105*b* and thus form edge seals. These seals 109*a*, 109*b* are often called transverse edge seals, since, when manufacturing the prior art product 101, these edge seals are made transverse to the direction of travel of the web forming the pouch. In the transverse seals, the packaging material forming the saliva-permeable pouch is double. The transverse edge seals 109*a*, 109*b* may be made by any method known to the skilled person, e.g. by means of heat-welding and/or ultrasonic welding. Since the transverse edge seals 109*a*, 109*b* are made after the longitudinal seal 107, i.e. downstream in the manufacturing apparatus, the longitudinal seal 107 is included in the transverse edge seals 109*a*, 109*b*, i.e. the longitudinal seal 107 forms part of the transverse edge seals 109*a*, 109*b*, The longitudinal seal 107 may e.g. be welded into the transverse edge seals 109*a*, 109*b*. Hence, at those locations, the packaging material forming the saliva-permeable pouch occurs four plies on top of each other.

Figure 2A:
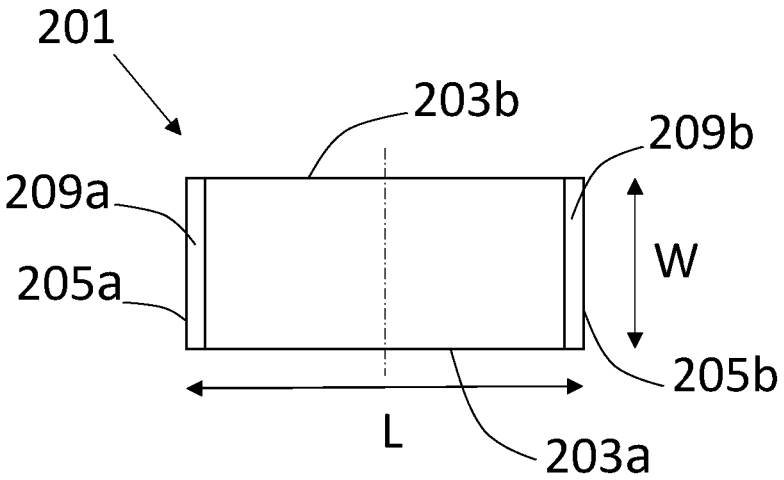
FIG. 2*a-b* illustrate a pouched product for oral use according to the invention.
Figure 2B:
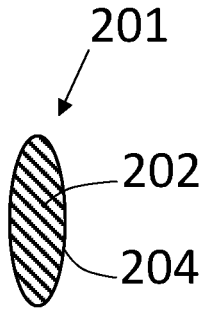

FIGS. 2*a* and 2*b* schematically illustrate a pouched product for oral use 201 according to the invention. The pouched product 201 comprises a filling material 202 and a saliva-permeable pouch 204 enclosing the filling material 202. It has a rectangular shape with a maximum length L extending in a length direction and a maximum width W extending in a width direction, whereby the maximum length L is greater than or equal to the maximum width W. The pouched product 201 also has an extension in a height direction, however not seen in this perspective.

The pouched product 201 according to the invention comprises two long side edges 203*a*, 203*b* and two short side edges 205*a*, 205*b*. Similar to the prior art product 101, the pouched product 201 according to the invention comprises two transverse seals 209*a*, 209*b*, with the terms longitudinal and transverse relating to the direction of travel of the piece of web forming the pouch as further described herein in relation to the apparatus and method. The transverse seals 209*a*, 209*b* form a first 209*a* and a second transverse edge seal 209*b* sealing a respective first edge portion and a second edge portion along the two short side edges 205*a*, 205*b* of the pouched product 201. The transverse edge seals 209*a*, 209*b* preferably extend all the way out to the respective short side edge 205*a*, 205*b*, but there may also be an interspace between the transverse edge seal 209*a*, 209*b* and the short side edge 205*a*, 205*b*. The transverse seals 209*a*, 209*b* may be made by any method known to the skilled person, e.g. by means of heat-welding, and/or ultrasonic welding.

The big difference to the prior art product 101, cf. FIG. 1*a-b*, is the absence of a longitudinal seal 107. Hence, for the pouched product 201 according to the invention, the saliva-permeable pouch 204 consists of a single ply of packaging material along a full length of the pouched product between the edge seals 205*a*, 205*b*, see the cross-sectional view in FIG. 2*b*.

Hence, although the pouched product 201 according to the invention and the prior art product 101 may have similar generally rectangular shapes, it can be seen that they differ from each other regarding the absence or presence of the at least one longitudinal seal 107. They may also differ as regards size and/or length to width ratio. They may also differ as regards the widths of the transverse seals. FIG. 1*a* shows a typical width for a seal made with the commonly used technology of heat-welding, while FIG. 2*a* shows a transverse seal made with ultrasonic welding, which typically is narrower than a seal made by heat-welding. Such a seal made with ultrasonic welding may have a width of less than 2 mm, preferably less than 1 mm, more preferably less than 0.5 mm.

Figure 3:
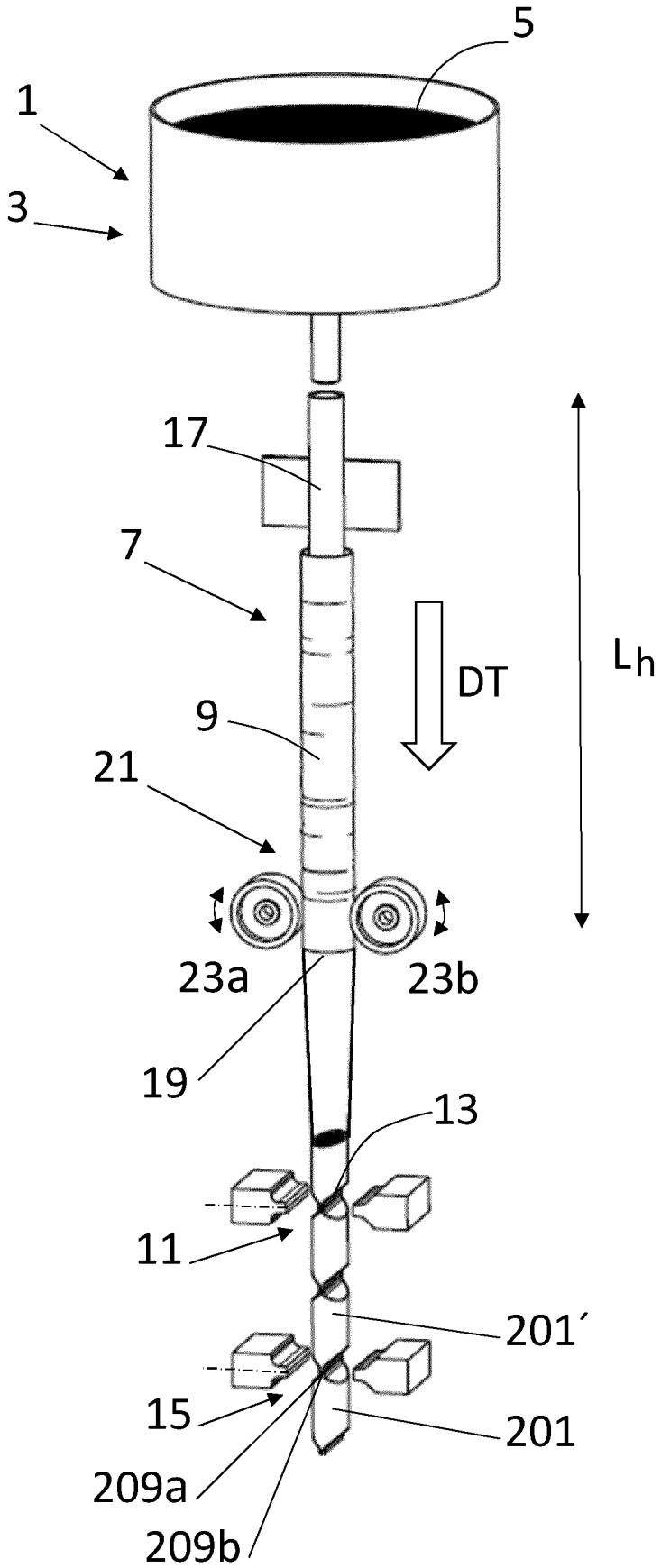
FIG. 3 illustrates an apparatus for manufacturing a pouched product for oral use according to the invention.

FIG. 3 schematically illustrates an apparatus 1 for manufacturing a pouched product 201 for oral use according to the invention. The features of the pouched product 201 are explained above in conjunction with FIG. 2*a-b*.

The apparatus 1 comprises a supplying unit 3 for supplying a filling material 5, a holding unit 7 for holding a piece 9 of tubular web of a saliva-permeable packaging material, a transverse sealing unit 11 for providing the piece 9 of tubular web with transverse seals 13 thereby forming a pouched product 201, and a separation unit 15 for separating the pouched product 201 from a subsequent pouched product 201' in or at the transverse seals 13.

The holding unit 7 comprises guiding provisions 17 for guiding the filling material 5 from the supplying unit 3 to be supplied into the piece 9 of tubular web at an end 19 of the holding unit 7. The holding unit 7 may comprise, or be constituted by, a filling tube, as is illustrated in FIG. 3. Thereby, the piece 9 of tubular web is held at the outside of the filling tube. Further, the filling tube functions as the guiding provisions 17, such that the filling material 5 may move through the filling tube from the supplying unit 3 into the piece 9 of tubular web.

Even if FIG. 3 illustrates an apparatus 1, in which the supplying unit 3 and the holding unit 7 are two separate units, it would also be feasible to combine them into a common unit. Hence, alternatively, the supplying unit 3 and the holding unit 7 may together form a single unit.

The piece 9 of tubular web has a predefinable length $L_p$ when provided to the holding unit 7. The piece 9 of tubular web may either be provided in a flat state, or in a gathered state. However the length $L_p$ when provided to the holding unit 7 is measured as the actual length of the piece 9 of tubular web as taken along the outer wall of the piece 9 of tubular web. However, FIG. 3 illustrates the apparatus 1 in operation. Accordingly, a portion of the length $L_p$ of the piece 9 of tubular web when provided to the holding unit 7 has already been used for making pouched products 201, 201'.

The flat state corresponds to the state the packaging material has in the pouch of the pouched product, i.e. a substantially flat surface although the pouched product has a three-dimensional shape, such as pillow-like, e.g. like a small flattened typically somewhat oblong pillow. If the piece 9 of tubular web is provided to the holding unit 7 in the flat state, a length $L_f$ in the flat state equals the length $L_p$ when provided to the holding unit 7. The length $L_f$ in the flat state is also predefinable, i.e. the piece 9 of tubular web does not form a section of a continuous web.

If provided in the gathered state, a length $L_g$ of the piece 9 of tubular web in the gathered state has been shortened in relation to the length $L_f$ in the flat state. In order to achieve this, the piece 9 of tubular web may be compressed in a length-wise direction. It may e.g. be folded or creased. If the piece 9 of tubular web is provided to the holding unit 7 in the gathered state, the length $L_g$ in the gathered state is the length $L_p$ when provided to the holding unit 7. If provided in the gathered state, the piece 9 of tubular web is preferably sequentially expanded to the flat state before supplying the filling material as is explained below. The length $L_g$ of the piece 9 of tubular web in the gathered state is less than the length $L_f$ in the flat state, $L_g<L_f$. The term gathered state is thereby to be understood as a pair together with the term flat state. Hence, the piece 9 of tubular web is expanded from the gathered state to the flat state. Correspondingly, the piece 9 of tubular web may be compressed from the flat state to the gathered state, which may occur when loading the piece 9 of tubular web onto the holding unit 7. In the illustrated embodiment of FIG. 3, the piece 9 of tubular web has been provided in the gathered state.

Knowing the length L of the product, see FIG. 2*a*, and the length $L_f$ of the piece 9 of tubular web in the flat state, it can be calculated how many pouched products 201, 201' can be made from the piece 9 of tubular web by the integer part of $L_f/L$. The length $L_f$ of the piece 9 of tubular web in the flat state may be adapted to the number of pouched products that are to be contained in an integer number of user containers, e.g. one, two or three user containers, such that loading of a new piece of tubular web may be synchronized with provision of a new user container. The length $L_f$ of the piece 9 of tubular web in the flat state may be in the range of 35-500 cm, preferably in the range of 40-400 cm, more preferably in the range of 45-300 cm, most preferably in the range of 50-200 cm, where the high numbers, relate to as provided in the gathered state.

A length $L_h$, of the holding unit 7 is at least 35 cm. The length $L_h$, of the holding unit 7 may be in the range of 35-200 cm, preferably in the range of 40-150 cm, more preferably in the range of 45-110 cm, most preferably in the range of 50-100 cm. With a greater length $L_h$, a longer piece 9 of tubular web may be held on the holding unit 7. However, the filling material 5 should be able to pass the guiding provisions 17 of the holding unit 7, which in practice puts an upper limit to the length $L_h$, of the holding unit 7. The predefinable length $L_p$ of the piece 9 of tubular web when provided to the holding unit 7 is preferably adapted to the length $L_h$, of the holding unit 7, such that the piece 9 of tubular web fits at the holding unit. The shorter the length $L_h$, of the holding unit 7 is, the more often a new piece of tubular web has to be provided, which may slow down production, which in practice puts a lower limit to the length $L_h$, of the holding unit 7.

The transverse sealing unit 11 is adapted to provide the piece 9 of tubular web with a series of transverse seals 13 by repeated transverse sealing. The transverse seals 13 are transverse to a direction of travel DT of the piece 9 of tubular web.

The transverse sealing unit 11 typically operates repetitively, such that two subsequent transverse seals 13 are interspaced by a repetition distance, determined as a centre-to-centre distance. The transverse sealing unit 11 may travel together with the piece 9 of tubular web for a predeterminable distance while performing the welding, as e.g. is described in EP 3383746 B1.

The transverse seals 13 made by the transverse sealing unit 11 typically have a length corresponding to a collapsed cross-sectional shape of the piece 9 of tubular web. The length of the transverse seal 13 is determined in a direction transverse to the direction of travel DT of the piece 9 of tubular web. When being transversely sealed, the tubular web is pressed together to a straight line of doubled packaging material giving the collapsed cross-sectional shape. Hence, the length of the transverse seal 13 equals, or substantially equals, half of the circumference of the piece 9 of tubular web. This corresponds to the maximum width W of the pouched product 201, see FIG. 2*a*.

The separation unit 15 is adapted to separate two consecutive pouched products 201, 201' for oral use from each other, e.g. by cutting, in or at the transverse seals 13. It is thus feasible to form a transverse seal 13 in the piece 9 of tubular web by means of the transverse sealing unit 11, which transverse seal 13 is cut at its centre or close to its centre, such that one part of the seal, e.g. substantially half the seal, forms a first transverse edge seal in one pouched product 201' and the other part of the seal, e.g. substantially the other half, forms a second transverse edge seal 209*b* in the preceding pouched product. In that case, the transverse seal 13 formed in the piece 9 of tubular web is substantially twice as wide, as seen in the direction of travel DT of the piece 9 of tubular web, as compared to an individual transverse edge seal 209*a*, 209*b* of the pouched product 201.

In the illustrated embodiment, the separation unit 15 is separate from the transverse sealing unit 11. The separation unit 15 may then be located spaced apart from the transverse sealing unit 11. It is then anyway preferable that the separation unit 15 operates in synchrony with the transverse sealing unit 11. However, it is also feasible to combine the transverse sealing unit 11 and the separation unit 15 into a common unit, see e.g. the apparatus disclosed in EP 3383746 B1.

As an alternative to cutting somewhere in the transverse seal 13 formed in the apparatus 1, as illustrated in FIG. 3, separation may be performed by means of cutting in an interspace between two separately formed transverse edge seals in the piece of tubular web. This may be performed by a knife or blade operating in the interspace. The two interspaced transverse edge seals may be made at the same time.

The transverse sealing unit 11 may be a heat-welding unit or an ultrasonic sealing unit. The transverse seal 13 may have a width of less than 2 mm, preferably less than 1 mm, more preferably less than 0.5 mm, especially if ultrasonically welded. An example of an ultrasonic sealing unit 11 for transverse sealing is given in EP 3383746 B1, wherein the sealing unit and the separation unit forms a combined unit.

In the illustrated embodiment, the apparatus 1 comprises an optional feeding unit 21 for feeding the piece 9 of tubular web in the direction of travel DT. The illustrated feeding unit 21 comprises a pair of pulling wheels 23*a*, 23*b*.

The feeding unit 21 is used to pull out the piece 9 of tubular web, thereby sequentially expanding the piece 9 of tubular web from the gathered state to the flat state. The feeding unit 21 is located at or adjacent to the end 19 of the holding unit 7, such that the filling material 5 is supplied into the piece 9 of tubular web when in the flat state.

Figure 5:
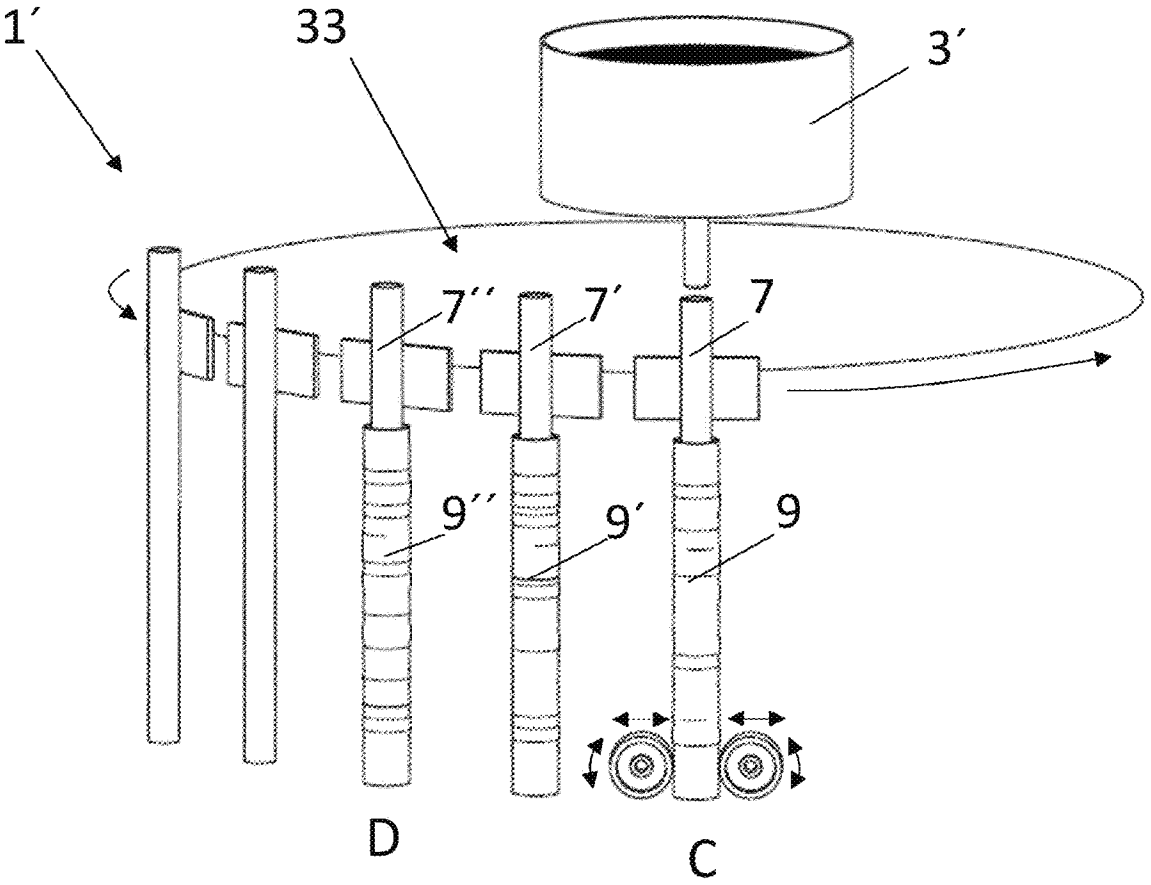
FIG. 5 illustrates an alternative way of loading a new piece of tubular web.
Figure 5:
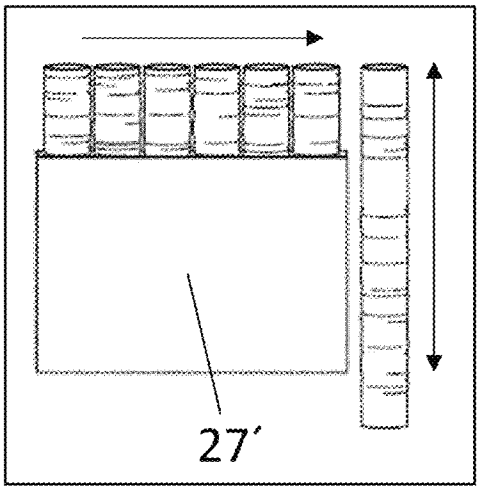
Figure 6:
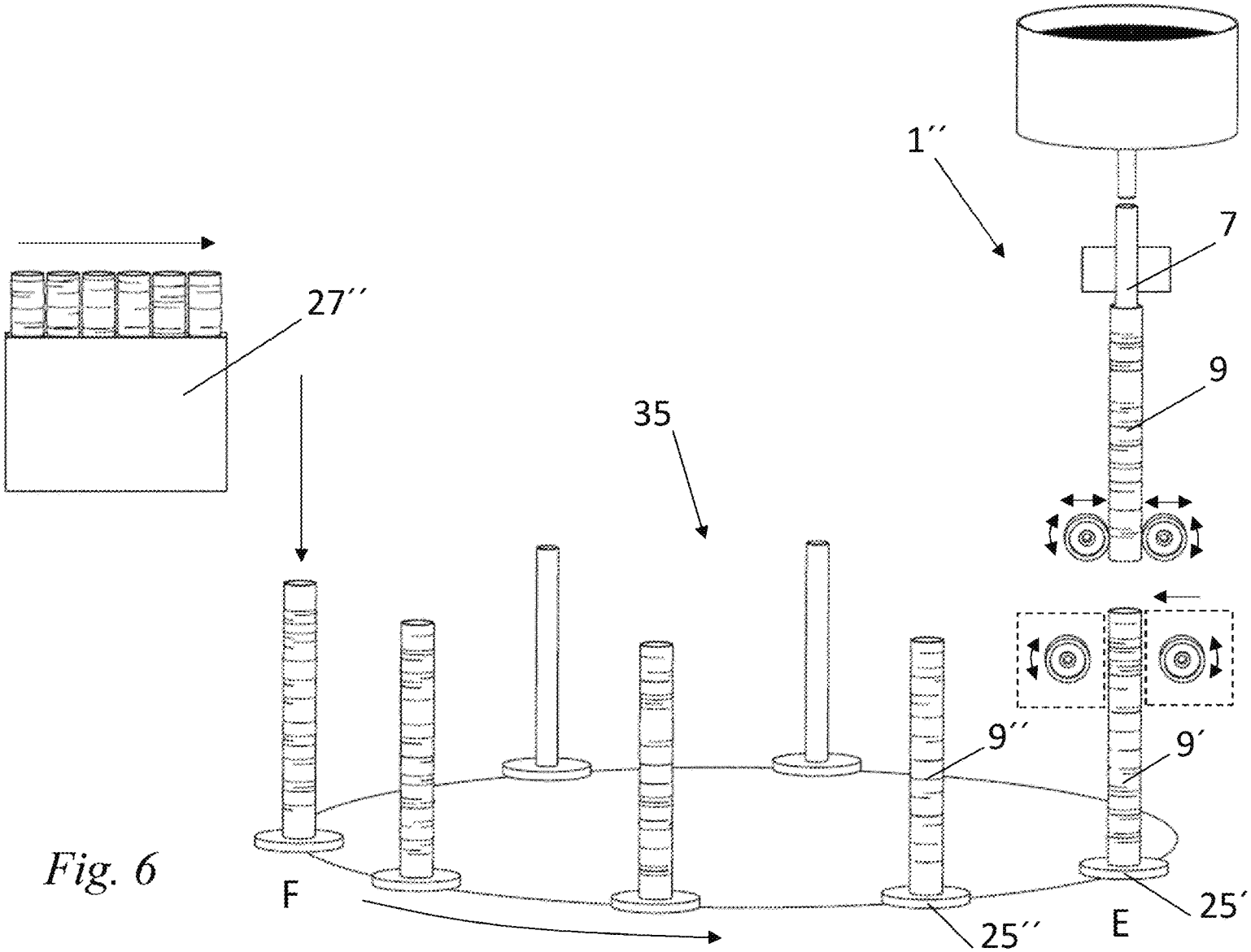
FIG. 6 illustrates yet an alternative way of loading a new piece of tubular web.

The feeding unit 21 may, in addition, be adapted to move the piece 9 of tubular web in a direction opposite to the direction of travel DT, such that the piece 9 of tubular web is loaded onto the holding unit 7. Hence, the same feeding unit 21 may be used both for loading the piece 9 of tubular web on the holding unit 7 and for feeding it in the direction of travel DT while making pouched products. Examples of different ways of loading a new piece 9 of tubular web are explained below in conjunction with FIG. 4-6. In these embodiments, the pulling wheels 23*a*, 23*b* are operable in both directions, such that they may be utilized to load the piece 9 of tubular web onto the holding unit 7. For simplicity, neither the transverse sealing unit 11, nor the separation unit 15, are shown in FIG. 4-6.

Figure 4:
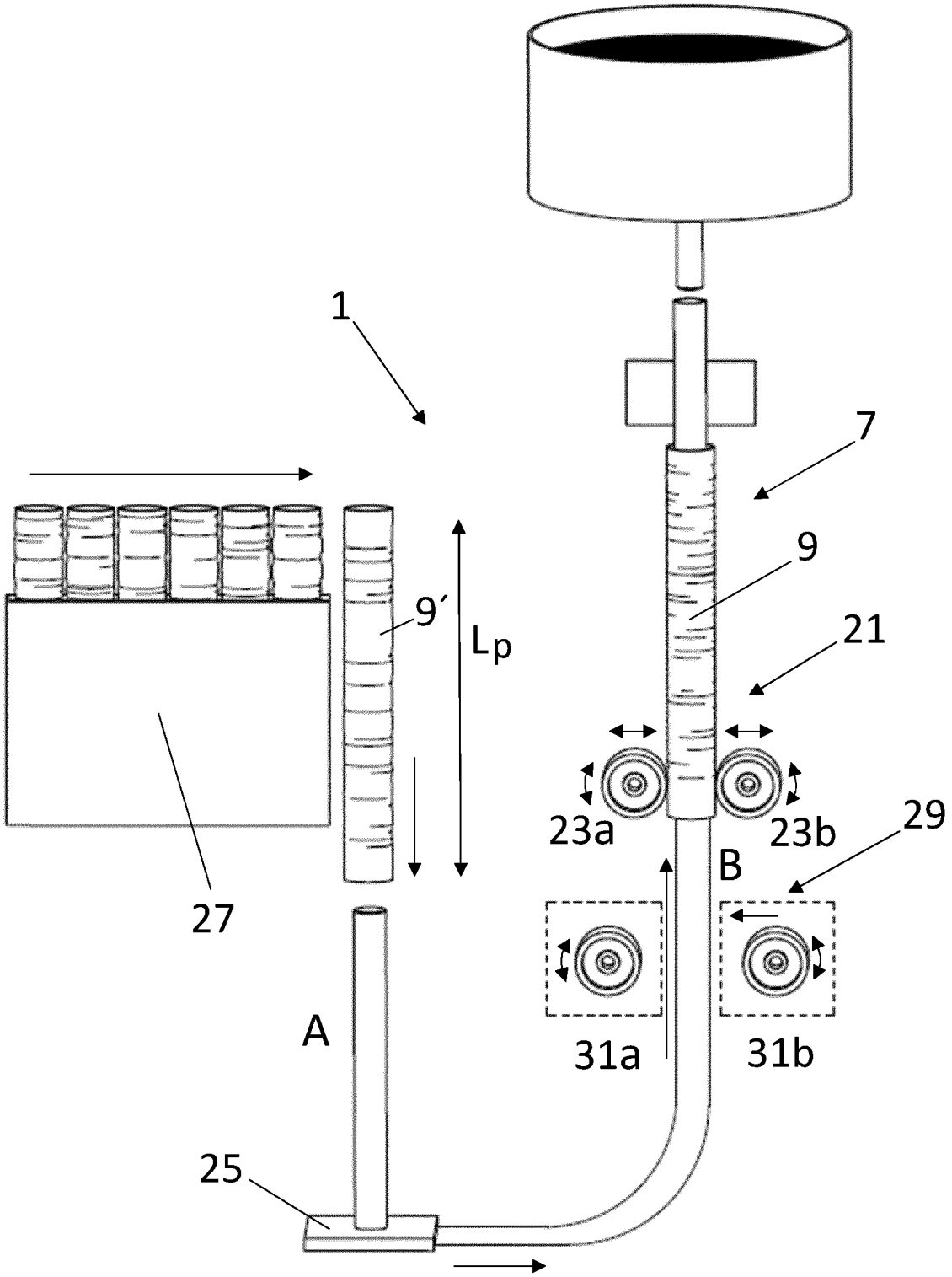
FIG. 4 illustrates loading of a new piece of tubular web.

FIG. 4 schematically illustrates a way of loading the apparatus 1 of FIG. 3 with a new piece 9' of tubular web. In this exemplary embodiment of the invention, the apparatus 1 further comprises a loading unit 25 and a storage unit 27 for storing at least one additional piece 9' of tubular web. The loading unit 25 is displaceable between a first position A located at the storage unit 27, in which the additional piece 9' of tubular web is movable from the storage unit 27 to the loading unit 25, and a second position B located at the holding unit 7, in which the additional piece 9' of tubular web is movable from the loading unit 25 to the holding unit 7. The new piece 9' of tubular web has such characteristics that it forms a kind of tube itself, which preferably is self-supportive. Thereby, the new piece 9' of tubular web is typically in the gathered state. Hence, in this embodiment, the new piece 9' of tubular web is stored in the storage unit 27 as is, i.e. not positioned on a holding unit.

The pulling wheels 23*a*, 23*b* of the feeding unit 21 are used to load the new piece 9' of tubular web onto the holding unit 7. The pulling wheels 23*a*, 23*b* are preferable movable in relation to the holding unit 7, such that they can be spaced apart from the holding unit 7, when the new piece 9' of tubular web is positioned at the end 19 of the holding unit 7, indicated with arrows in FIG. 4. Thereafter, the pulling wheels 23*a*, 23*b* are moved back into contact with the new piece 9' of tubular web such that they can move the new piece 9' of tubular web in order to load the whole new piece 9' of tubular web onto the holding unit 7.

In order to facilitate the positioning and the loading of the new piece 9' of tubular web, the apparatus 1 may comprise an additional feeding unit 29, e.g. comprising a pair of additional loading wheels 31*a*, 31*b*.

In an alternative way of loading the new piece 9', 9" of tubular web, see FIG. 5, the apparatus 1' comprises a plurality of holding units 7, 7', 7" adapted to be used sequentially together with the supplying unit 3. Each holding unit 7, 7', 7" is adapted to hold a respective separate piece 9, 9', 9" of tubular web of saliva-permeable packaging material, which may be in gathered state or in a flat state. The holding units 7, 7', 7" are adapted to be used one at the time after each other. The holding unit 7, 7', 7" may thus be prepared in advance and/or outside the apparatus 1' by loading a piece of tubular web 9, 9', 9" onto it, e.g. from the storage unit 27'. Hence, when a first piece 9 of tubular web has been transformed into pouched products and it is time to shift to a new piece 9' of tubular web, the whole holding unit 7 is shifted in relation to the supplying unit 3', such that a new holding unit 7' is moved to the supplying unit 3' of the apparatus 1' carrying a new piece of tubular web 9'. Such a solution may increase the output of the apparatus 1', since the manufacturing of pouched products is not slowed down by loading a new piece 9' of tubular web. The other components of the apparatus 1' correspond to those of the apparatus 1 of FIG. 3 and are not described again.

The apparatus 1' according to the invention may, as an option, comprise a magazine 33 being adapted for storing the plurality of holding units 7', 7", preferably with a new piece 9', 9" of tubular web loaded on the respective holding unit 7', 7". The magazine 33 is adapted to move one holding unit 7' 7" at a time into a filling position C in relation to the supplying unit 3', e.g. by means of a linear and/or rotational translation of the magazine 33 in relation to the supplying unit 3. The new piece 9', 9" of tubular web may be loaded onto the respective holding unit 7', 7" at a loading position D by supplying a new piece 9', 9" of tubular web from the storage unit 27'.

FIG. 6 schematically illustrates an embodiment of the apparatus 1" according to the invention, in which the new pieces 9', 9" of tubular web are positioned on a respective loading unit 25', 25". The loading units 25', 25" are located in a magazine 35. The magazine 35 is adapted to move one of the new pieces 9', 9" of tubular web at a time into a filling position E in relation to the holding unit 7, e.g. by means of a linear and/or rotational translation of the magazine 35 in relation to the holding unit 7. The new piece 9', 9" of tubular web may be loaded onto the respective loading unit 25', 25" at a loading position F by supplying a new piece 9', 9" of tubular web from the storage unit 27". The new piece 9', 9" of tubular web may be loaded onto the holding unit 7 in the way described above in conjunction with FIG. 4.

Figure 7:
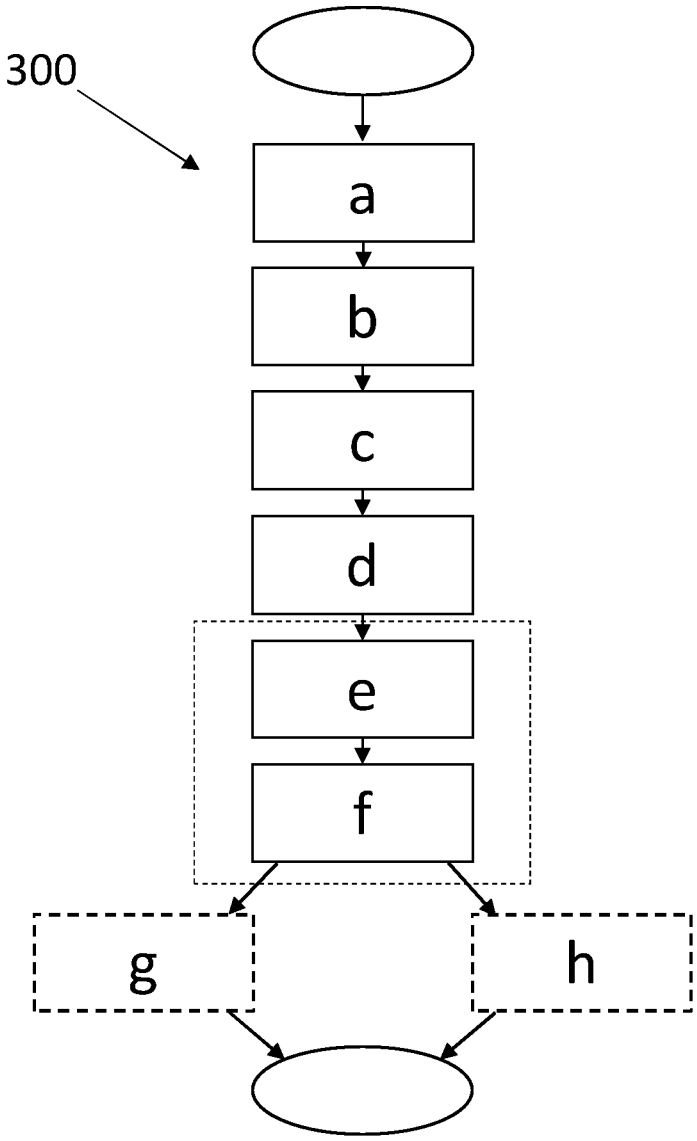
FIG. 7 illustrates a method for manufacturing a pouched product for oral use according to the invention.

FIG. 7 illustrates a method 300 for manufacturing a pouched product for oral use. The method comprises:

a) providing and holding a piece of tubular web of a saliva-permeable packaging material on a holding unit, the piece of tubular web having a predefinable length when provided to the holding unit, b) providing the piece of tubular web with a first transverse seal, c) supplying a filling material through the holding unit into the piece of tubular web, d) advancing the piece of tubular web in a direction of travel, e) providing the piece of tubular web with a second transverse seal thereby forming a pouched product, f) separating the pouched product from a subsequent pouched product in or at the second transverse seal.

The method is preferably performed by an apparatus as described herein. For details of the method steps, please see also the description of the corresponding parts of the apparatus. The piece of tubular web may be moving continuously when performing the method.

Commonly, the transverse sealing is performed in such a way that a second transverse edge seal, e.g. an upper edge seal 209*b*, of a first pouched product 201 and a first transverse edge seal of a second subsequent pouched product 201', e.g. a lower edge seal 209*a*, are formed in the same step. See FIG. 3 and description above of the apparatus 1 for details. Hence, step e) for a first pouched product 201 is performed simultaneously as step b) for the subsequent pouched product 201', possibly by the same transverse sealing unit 11.

In step a), the piece of tubular web of saliva-permeable packaging material may be provided in the gathered state and held on the holding unit in the gathered state, and step b), c) and/or d) may be performed while expanding the piece of tubular web from the gathered state to the flat state, wherein a length of the piece of tubular web, when in the gathered state, is less than a length of the piece of tubular web when in the flat state. Please see the description of the apparatus for further details.

The length of the piece of tubular web in the gathered state may be in the range of 35-200 cm, preferably in the range of 40-150 cm, more preferably in the range of 45-110 cm, most preferably in the range of 50-100 cm. Please see the description of the apparatus for further details.

The transverse sealing and separation, see steps e) and f) may be performed as a single common operation in a single unit, e.g. by the sealing device disclosed in EP 3383746 B1, see dashed box in FIG. 7. Hence, transverse sealing and separation may be performed simultaneously and in the same operation step. It may further be performed by the same operation surface as disclosed in the sealing device of EP 3383746 B1.

The method may comprise a step g) of loading a new piece of tubular web of saliva-permeable packaging material onto the holding unit. The step of loading may be combined with a step of gathering the piece of tubular web during the loading. Alternatively, the piece of tubular web may be loaded as is in the flat state or as already being in the gathered state. Please see the description of the apparatus for further details.

The method may comprise a step h) of exchanging an empty holding unit to a new holding unit comprising a new piece of tubular web of saliva-permeable packaging material. The new piece of tubular web may be as is, i.e. in the flat state, or in the gathered state.

Further modifications of the invention within the scope of the appended claims are feasible. As such, the present invention should not be considered as limited by the embodiments and figures described herein. Rather, the full scope of the invention should be determined by the appended claims, with reference to the description and drawings.

The invention claimed is:

1. An apparatus for manufacturing a pouched product for oral use, said apparatus comprising:

a supplying unit configured to supply a filling material, a holding unit configured to hold a piece of tubular web of a saliva-permeable packaging material, said piece of tubular web having a predefined length when provided to said holding unit, a transverse sealing unit configured to provide said piece of tubular web with transverse seals thereby forming a pouched product, and a separation unit configured to separate said pouched product from a subsequent pouched product in or at said transverse seals, wherein said holding unit comprises guiding provisions for guiding said filling material from said supplying unit to be supplied into said piece of tubular web at an end of said holding unit, and wherein a length of said holding unit is at least 35 cm.

2. The apparatus according to claim 1, wherein said length of said holding unit is in the range of 35-200 cm.

3. The apparatus according to claim 1, wherein said holding unit is configured to hold said piece of tubular web in a gathered state, said apparatus further comprising:

a feeding unit configured to feed said piece of tubular web in a direction of travel of said piece of tubular, thereby sequentially expanding said piece of tubular web from said gathered state to a flat state, wherein said feeding unit is located at or adjacent to said end of said holding unit, such that said filling material is supplied into said piece of tubular web when in said flat state.

4. The apparatus according to claim 3, wherein said feeding unit is configured to move said piece of tubular web in said gathered state in a direction opposite to said direction of travel, such that said piece of tubular web is loaded onto said holding unit.

5. The apparatus according to claim 3, wherein said feeding unit comprises one or more pulling wheels or pulling belts configured to pull out said piece of tubular web, thereby sequentially expanding it from said gathered state to said flat state.

6. The apparatus according to claim 1, wherein said apparatus further comprises a loading unit and a storage unit for at least one additional piece of tubular web, said loading unit being displaceable between a first position located at said storage unit, in which said additional piece of tubular web is movable from said storage unit to said loading unit, and a second position located at said holding unit, in which said additional piece of tubular web is movable from said loading unit to said holding unit.

7. The apparatus according to claim 1, comprising a plurality of holding units configured to be used sequentially together with said supplying unit, each holding unit being configured to hold a respective separate piece of tubular web of saliva-permeable packaging material.

8. The apparatus according to claim 7, wherein said apparatus further comprises a magazine configured to store said plurality of holding units, said magazine also configured to move one holding unit at a time into a filling position in relation to said supplying unit.

9. A method for manufacturing a pouched product for oral use, said method comprising:

a) providing and holding a piece of tubular web of a saliva-permeable packaging material on a holding unit, said piece of tubular web having a predefined length when provided to said holding unit, b) providing said piece of tubular web with a first transverse seal, c) supplying a filling material through said holding unit into said piece of tubular web, d) advancing said piece of tubular web in a direction of travel, e) providing said piece of tubular web with a second transverse seal thereby forming a pouched product, and f) separating said pouched product from a subsequent pouched product in or at said second transverse seal.

10. The method according to claim 9, wherein a length of said piece of tubular web as seen in a flat state is in the range of 35-500 cm.

11. The method according to claim 9, wherein, in step a), said piece of tubular web of saliva-permeable packaging material is provided in a gathered state and held on said holding unit in said gathered state, wherein step b), c) or d) is performed while expanding said piece of tubular web from said gathered state to said flat state, and wherein a length of said piece of tubular web, when in said gathered state, is less than a length of said piece of tubular web when in said flat state.

12. The method according to claim 11, wherein said length of said piece of tubular web in said gathered state is in the range of 35-200 cm.

13. The method according to claim 9, wherein said method further comprises:

loading a new piece of tubular web of saliva-permeable packaging material onto said holding unit.

14. The method according to claim 9, wherein said method further comprises:

exchanging an empty holding unit to a new holding unit comprising a new piece of tubular web of saliva-permeable packaging material.

* * * * *